US005599079A

United States Patent [19]

Ranno et al.

[11] Patent Number: 5,599,079

[45] Date of Patent: Feb. 4, 1997

[54] PRODUCT DISPLAY STAND, AND METHOD OF STORING AND DISPLAYING PRODUCTS USING THE SAME

[76] Inventors: Douglas Ranno, 1247 Martin Dr., Apt. B, Cincinnati, Ohio 45202; David S. Stevens, 23609 65th St., Salem, Wis. 53168

[21] Appl. No.: 293,518

[22] Filed: Aug. 19, 1994

[51] Int. Cl.[6] ..... A47F 3/04

[52] U.S. Cl. ..... 312/323; 108/108; 312/116; 62/252

[58] Field of Search ..... 312/116, 236, 312/323, 312, 310, 198, 322, 295, 350, 334.7, 334.8; 62/251–253, 256, 257, 282, 82; 108/108

[56] References Cited

U.S. PATENT DOCUMENTS

| | | | |
|---|---|---|---|
| D. 43,164 | 10/1912 | Russell . | |
| D. 134,243 | 11/1942 | King . | |
| D. 139,202 | 8/1944 | Beaudr . | |
| 1,197,576 | 9/1916 | Doane et al. . | |
| 1,380,188 | 5/1921 | Burritt | 312/116 X |
| 1,916,213 | 7/1931 | Duke . | |
| 2,458,190 | 1/1949 | Newburger . | |
| 2,502,076 | 3/1950 | Denton . | |
| 2,529,384 | 11/1950 | Greiling | 62/252 |
| 2,826,046 | 3/1958 | Tobiasz . | |
| 2,853,352 | 9/1958 | Gittins | 312/323 X |
| 3,933,006 | 1/1976 | South . | |
| 3,990,754 | 11/1976 | Pitel et al. | 312/323 X |
| 4,314,734 | 2/1982 | Grunert | 312/323 X |
| 4,441,771 | 4/1984 | Roesler | 312/323 X |
| 4,523,439 | 6/1985 | Denisot . | |
| 4,850,120 | 7/1989 | Stein . | |
| 4,899,554 | 2/1990 | Kato et al. | 62/252 X |
| 5,121,877 | 6/1992 | Bodary et al. | 229/120 |
| 5,277,486 | 1/1994 | Bustos | 312/116 X |
| 5,306,077 | 4/1994 | Trevaskis | 312/323 X |
| 5,336,049 | 8/1994 | Herman | 312/236 X |

FOREIGN PATENT DOCUMENTS

| | | |
|---|---|---|
| 2524290 | 10/1983 | France . |
| 2593690 | 8/1987 | France . |
| 496599 | 4/1930 | Germany . |
| 1435072 | 5/1976 | United Kingdom . |

OTHER PUBLICATIONS

International Search Report, dated Mar. 28, 1996.

*Primary Examiner*—Peter M. Cuomo
*Assistant Examiner*—Robert J. Sandy
*Attorney, Agent, or Firm*—Frost & Jacobs

[57] ABSTRACT

A product display stand is provided, the stand comprising:

(a) at least one display surface for displaying the product thereupon;

(b) a first vertical face positioned beneath the display surface; and (c) a first drawer positioned beneath the display surface for storing the product, the drawer movable between a closed position and an open position, wherein the drawer is disposed within the stand when the drawer is at the closed position, wherein the drawer is angled downwardly when the drawer is at the open position, and wherein the drawer may be moved from the closed position to the open position by slideably moving the drawer from the interior of the stand in the direction of the vertical face.

An optional cooling/humidification unit may be provided inside the stand. A method of displaying and storing produce using this stand is also provided.

13 Claims, 12 Drawing Sheets

PRODUCT DISPLAY STAND, AND METHOD OF STORING AND DISPLAYING PRODUCTS USING THE SAME

BACKGROUND OF INVENTION

1. Field of the Invention

The present invention relates to an improved product display stand, and an improved method for storing and displaying product using this display stand. More particularly, the display stand of the present invention permits the user to not only place the products to be displayed atop the display surface of the stand, but also to store containers (i.e., boxes) of the product within drawers contained within the stand. The drawers of the display stand are moveable between a closed position wherein the containers are held within the display stand, and an open position wherein the drawers extend partially from the stand in a downwardly-angled configuration. When one wishes to use the display stand of the present invention for perishables such as bananas, an optional cooling/humidification unit may be placed within the interior of the display stand to thereby provide cool and/or humidified air to the produce placed in the drawers of the stand.

2. Description of Related Art

Most products sold from retail establishments such as grocery stores are placed on display stands of one type or another. The stands are typically designed to not only present the products in a fashion pleasing to the eye, but also to protect the product from damage. In some instances, the products must also be maintained in a controlled atmosphere in order to prevent their deterioration. This is particularly true for produce items, as many must be maintained in a cool, moist atmosphere in order to preserve freshness and a pleasing appearance.

It is also desirable to present the products in an eye-catching arrangement in order to enhance product sales. Thus, products are often displayed on free-standing units having one or more display surfaces. The display surfaces can be arranged in a tiered or other arrangement in order to not only provide an aesthetically-pleasing display, but also to improve consumer access to the product. For such displays, however, it is usually desirable to ensure that the display surfaces of the stand are completely filled with product. Studies have shown that sales of products such as bananas or other produce increase markedly when a completely filled display is presented to the consumer. In order to achieve such a display, however, products removed from the display surface must be continually replaced. Such replacement of product can be a labor-intensive task, as additional product not on display is typically kept in storage areas located away from the retail area. Thus, there is a need for a display stand having easily-accessible internal storage compartments.

As mentioned previously, many products are preferably displayed and/or stored in a controlled atmosphere. Thus, numerous display units offering chilling and/or moistening of the product have been developed. With many products, however, it is either not desirable or not feasible to display the product in a controlled atmosphere. For example, while many produce items benefit from being either refrigerated or stored on ice, certain produce items will be damaged by too low of temperatures. This is particularly true of bananas, which are preferably maintained in a humidified atmosphere at a temperature of between 56° and 59° F. This cool, humidified atmosphere retards the ripening of the bananas, thereby prolonging their shelf life, and also maintains the moisture content of the fruit. Thus, it is not feasible to display bananas in a conventional refrigerated or iced display unit, and the controlled atmosphere display of bananas has heretofore not been possible.

Since bananas account for 10% of all produce sales, it is also desirable to display bananas in their own free-standing display positioned apart from other produce items. Such displays are, however, not conducive to the provision of a cooled, humidified atmosphere. This problem is heightened by the fact that it is normally desirable to display the bananas in a single layer in order to prevent bruising. In addition, while numerous flee-standing, multi-layered banana display stands have been developed, all require the grocer to continually replace bananas which are quickly removed from the stand. Usually this requires that boxes of bananas be retrieved from storage rooms for replenishment of the display. Most grocery stores, however, lack a storage area wherein the bananas can be maintained at the desired appropriate temperature and humidity. In fact, many of the storage rooms are at an even higher temperature than the retail area, which results in increased ripening of the bananas in these storage rooms (thereby decreasing their shelf life). In these grocery stores, the retail floor space may often be more appropriate than the storage room, since the temperature will be somewhat reduced. Thus, there is a need for a banana display stand wherein spare boxes of bananas may be stored within the stand itself.

SUMMARY OF THE INVENTION

It is an object of the present invention to provide a product display stand for displaying and storing products.

It is another object of the present invention to provide a product display stand for displaying and storing products, wherein the products can be displayed on the display surface of the stand, and excess product can be stored within sliding drawers secured within the stand.

It is yet another object of the present invention to provide a display stand as described above, wherein a cooling/humidification unit placed in the interior of the stand dispels cooled and/or humidified air into the drawers.

It is still another object of the present invention to provide a method of displaying and storing produce, such as bananas, using the display stand described above.

Additional objects, advantages, and other novel features of the present invention will be set forth in the description which follows, and will also be apparent to those skilled in the art upon examination of the following or may be learned with the practice of the invention.

The foregoing objects can be accomplished, in accordance with one aspect of the present invention, by providing a product display stand comprising:

(a) at least one display surface for displaying the product thereupon;

(b) a first vertical face positioned beneath the display surface; and (c) a first drawer positioned beneath the display surface for storing the product, the drawer movable between a closed position and an open position, wherein the drawer is disposed within the stand when the drawer is at the closed position, wherein the drawer is angled downwardly when the drawer is at the open position, and wherein the drawer may be moved from the closed position to the open position by slideably moving the drawer from the interior of the stand in the direction of the vertical face.

The front of the drawer is preferably positioned flush with the first vertical face when the drawer is at said closed position, and at least a portion of the drawer is positioned externally of the stand when the drawer is at the open position. The first drawer also preferably has a right side and a left side, and the stand further comprises first and second vertical support members positioned within the stand. The first vertical support member is positioned adjacent and parallel to the right side of the drawer, and the second vertical support member is positioned adjacent and parallel to the left side of the drawer, and each side of the drawer is slideably attached to the adjacent vertical support member.

In order to provide the slidable attachment of the drawer, the first and second vertical support members each have a first slide channel, wherein each of these first slide channels has a horizontal section and a downwardly extending section, with the downwardly extending section having a terminus. The drawer itself then further comprises:

(a) at least one right slide coupling rigidly secured to, and extending away from, the right side of the drawer, wherein a portion of the right slide coupling is slideably positioned within the first slide channel of the first vertical support member; and (b) at least one left slide coupling rigidly secured to, and extending away from, the left side of the drawer, wherein a portion of the left slide coupling is slideably positioned within the first slide channel of the second vertical support member.

The right and left slide couplings can slideably move from the horizontal section of their respective slide channels to the terminus of the downwardly extending section as the drawer is moved from the closed position to the open position, thereby causing the drawer to angle downwardly after being moved to the open position.

Each of the vertical support members also preferably has a second horizontal slide channel, and the drawer further comprises:

(a) a second right slide coupling secured to, and extending away from, the right side of the drawer, the second right slide coupling located rearwardly of the first right slide coupling, wherein a portion of the second right coupling is slideably positioned within the second slide channel of the first vertical support member; and (a) a second left slide coupling secured to, and extending away from, the left side of the drawer, the second left slide coupling located rearwardly of the first left slide coupling, wherein a portion of the second left coupling is slideably positioned within the second slide channel of the second vertical support member.

The display stand of the present invention preferably comprises a plurality of such drawers, and one of these may be positioned beneath the first drawer described above. The additional drawers are preferably attached in the identical manner as that described above, and are therefore also moveable between a closed position and an open position.

Additional drawers may also be provided along the other vertical faces of the stand, and thus the stand of the present invention may further comprise:

(a) a second vertical face positioned beneath the display surface, and contiguous with the first vertical face;

(b) a second drawer positioned beneath the display surface, the second drawer movable between a closed position and an open position, the second drawer having right and left sides; and (c) third and fourth vertical support members (equivalent to the first and second vertical support members described above) positioned within the stand, the third vertical support member positioned adjacent and parallel to the right side of the second drawer, and the fourth vertical support member positioned adjacent and parallel to the left side of the second drawer, wherein each side of the second drawer is slideably attached to the adjacent vertical support member;

wherein the first drawer (previously described) has a rear face, and wherein at least a portion of the rear face of the first drawer is positioned adjacent and parallel to the fourth vertical support member when the first drawer is at the closed position. In other words, the first and second drawers are merely rotated 90 degrees from one another when the display stand is rectangular in shape. Third and fourth drawers may similarly be provided on the remaining faces, with these drawers slideably attached to fifth and sixth vertical support members, and seventh and eighth vertical support members, respectively. Thus, when the display surface is rectangular, the eight vertical support members are arranged to form four L-shaped supports positioned beneath each of the four corners of the display surface, wherein each of the L-shaped supports comprises two of the vertical support members. As described below in more detail, a cooling unit capable of dispelling cooled air may also be provided. The cooling unit is preferably positioned beneath the display surface and within the stand, such that the cooled air can be dispelled into the drawers, thereby cooling product stored within the drawer.

The foregoing objects may also be accomplished by providing a product display stand comprising:

(a) at least one display surface for displaying the product thereupon;

(b) a first vertical face positioned beneath the display surface;

(c) a first drawer positioned beneath the display surface for storing the product, the drawer movable between a closed position and an open position, wherein the drawer is disposed within the stand when the drawer is at the closed position, wherein the drawer is angled downwardly when the drawer is at the open position, and wherein the drawer may be moved from the closed position to the open position by slideably moving the drawer from the interior of the stand in the direction of the vertical face; and (d) a cooling unit capable of dispelling cooled air, the cooling unit positioned beneath the display surface and within the stand, such that the cooled air can be dispelled into the drawer, thereby cooling product stored within the drawer.

The cooling unit has an air intake, and the stand further comprises an air channel aligning the intake with the ambient so that air entering the cooling unit can be drawn from the ambient through the air channel into the intake. An airflow baffle may be positioned beneath the display surface, the baffle positioned so as to provide the air channel aligning the air intake and the ambient so as to the air channel. This baffle may be positioned beneath the drawer parallel to the surface upon which the stand rests.

The interior of the display stand may also comprise a plenum chamber having an air pressure greater than the ambient air pressure. In this embodiment the cooling unit has at least one vent through which cooled air is expelled into the plenum chamber, and the stand has at least one air duct which provides fluid communication between the plenum chamber and the drawer such that cooled air in the plenum chamber can be expelled through the duct into the drawer. The display stand may further comprise at least one air hose secured to the cooling unit such that cooled air dispelled from the cooling unit can be forced through the air hose. Since the drawer has a rear face having at least one air duct, the air hose may be attached to the rear face in fluid communication with the air duct, such that cooled air dispelled from the cooling unit will pass through the hose and the air duct into the drawer. Alternatively, a vertical support member may be positioned within the stand, with the rear face of the drawer positioned parallel and adjacent to the vertical support member. The air hose may then be attached to the vertical support member in fluid communication with an air duct provided on the support member, such that cooled air dispelled from the cooling unit will pass through the hose and the air duct into the drawer.

There is also provided a method for displaying and storing bananas, comprising the steps of:

(a) providing a plurality of boxes containing bananas;

(b) providing a product display stand comprising:

at least one display surface for displaying the product thereupon;

a first vertical face positioned beneath the display surface; and a first drawer positioned beneath the display surface for storing the product, the drawer movable between a closed position and an open position, wherein the drawer is disposed within the stand when the drawer is at the closed position, wherein the drawer is angled downwardly when the drawer is at the open position, and wherein the drawer may be moved from the closed position to the open position by slideably moving the drawer from the interior of the stand in the direction of the vertical face;

(c) removing a portion of the bananas contained in the boxes and placing the removed bananas upon the display surface;

(d) placing the boxes containing the remaining bananas in the drawer;

(e) displaying the stand to customers, so that the customers may remove the bananas from the display surface for purchase; and (f) removing at least a portion of the remaining bananas from the boxes in the drawer, and placing the portion of the remaining bananas on the display surface in order to replace the bananas removed by customers.

This method may further comprise the step of moving the drawer to the closed position after the boxes containing the remaining bananas are placed in the drawer. Preferably the following additional steps are performed:

(a) providing a cooling unit capable of dispelling cooled air, the cooling unit positioned beneath the display surface and within the stand, such that the cooled air can be dispelled into the drawer, thereby cooling product stored within the drawer; and (b) dispelling cooled air from the cooling unit into the drawer in order to cool bananas stored in the drawer.

The cooled air is preferably dispelled at a temperature of between about 50° and about 60° F. While bananas are preferably maintained at a temperature of between 56° and about 59° F., lower temperatures may be preferred for the cooled air due to heat gains from the surroundings. Of course the temperature of the cooled air can be controlled to maintain the appropriate pulp temperature for the bananas.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Reference will now be made in detail to the presently preferred embodiments of the invention, examples of which are illustrated in the accompanying drawings, wherein like numerals indicate the same elements throughout the views.

Figure 1:
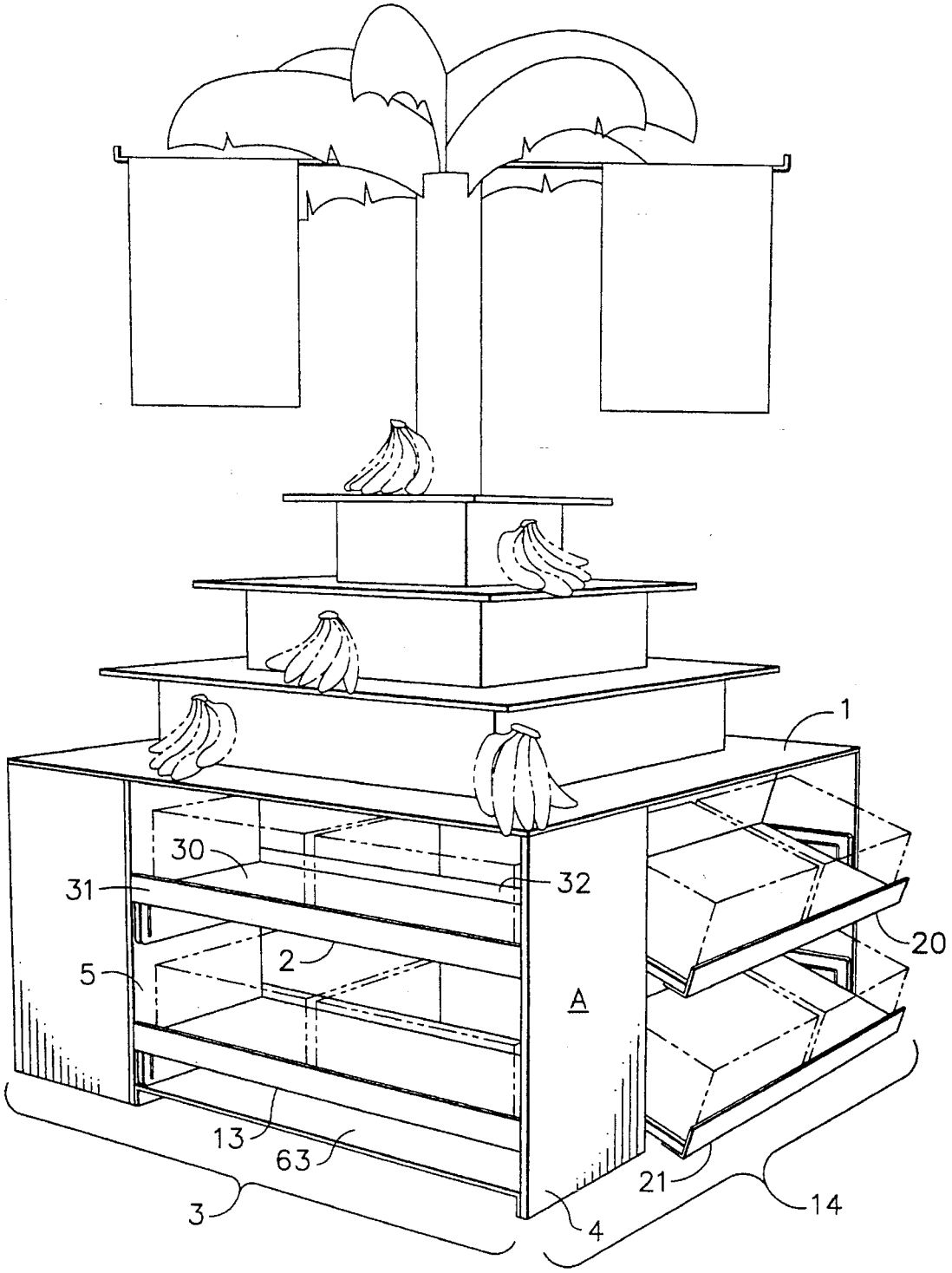
FIG. 1 is a perspective view of one embodiment of the invention.

FIG. 1 depicts a product display stand of the present invention, this stand being suitable for displaying various types of products to consumers in a retail outlet. The display stand of the present invention is particularly suited for displaying produce such as bananas, however the present invention should not be considered limited to only such uses.

The display stand of FIG. 1 comprises at least one display surface 1 for displaying the product thereupon. While it is possible to provide a single planar display surface on the stand, it is usually desirable to provide a tiered construction having multiple display surfaces such as that shown in the device of FIG. 1. In this fashion, the product can be displayed in a single layer on each display surface with the product on each tier easily accessible to the consumer. Numerous other configurations for multiple display surfaces can be employed, and these arrangements are well-within the scope of the present invention. The display stand of FIG. 1 is also shown as having an aesthetic enhancement comprising a tree extending vertically above the upper most display surface. Such an enhancement is merely for aesthetic purposes, and generally serves no structural function in the preferred embodiments. Display banners are also shown as being supported by the tree enhancement, and may be used to provide various indicia to the consumer.

The display stand of FIG. 1 also has at least one, and preferably a plurality of drawers positioned beneath the display surface. These drawers can be used for storing additional product, and are preferably sized so that at least one container (i.e., a box) can be positioned within the drawers. The drawers are movable between a closed position and an open position. The drawers are disposed within the stand when in the closed position. When moved to the open position the drawers angle downwardly, and preferably a portion of the drawer is positioned externally of the stand. As will be more fully understood herein, when a drawer is in its open position, the product contained therein is readily accessible by someone positioned adjacent to the drawer. In addition, the downward angularity of the drawers in their open position provides an aesthetically pleasing presentation for product contained therein. Thus, the drawers may even be maintained in their open position during use to thereby provide visual recognition of their contents. When boxes are placed within the drawers, their tops may be opened or removed to provide further physical and visual access to their contents. For example, bananas are typically shipped in rectangular boxes having a top and bottom portion. By removing the top portion of these boxes and displaying them in open drawers of the stand of FIG. 1, the consumer will be presented with an aesthetically-pleasing display of bananas both on top of the display surfaces and also within the banana boxes stored in the open drawers. Such a display of bananas within their shipping boxes may also enhance the perceived freshness of the product.

First drawer 2 of the stand in FIG. 1 is positioned directly beneath display surface 1. Drawer 2 also preferably is positioned flush with first vertical face 3 of the display stand when drawer 2 is in the closed position as shown, however the drawers may be further recessed into the stand if desired. It should be noted that the term "vertical face" merely refers to the front portion of the display stand which extends vertically downward from display surface 1. As further shown in FIG. 1, drawer 2 is preferably sized to snugly accommodate two banana boxes of a standard size. Obviously drawer 2 could be sized as needed, depending upon the product being displayed and stored. A second drawer 13 is also preferably provided directly beneath and parallel to first drawer 2.

Obviously, display surface 1, as well as drawers 2 and 3 must be supported in some fashion. Thus, first and second vertical support members 4 and 5, respectively, are provided. The vertical support members, as well as display surface 1, and the drawers themselves can be manufactured from numerous materials. Preferably, however, due to strength, rigidity, and cost, wood is preferred for all of these structures. First vertical support member 4 is positioned adjacent and parallel to the right side of drawers 2 and 13, and second vertical support member 5 is positioned adjacent and parallel to the left side of drawers 2 and 13. As is apparent from FIG. 1, display surface 1 rests atop vertical support members 4 and 5, and may be secured to support members 4 and 5 by any suitable means such as nailing, gluing, or other fastening means.

Figure 3:
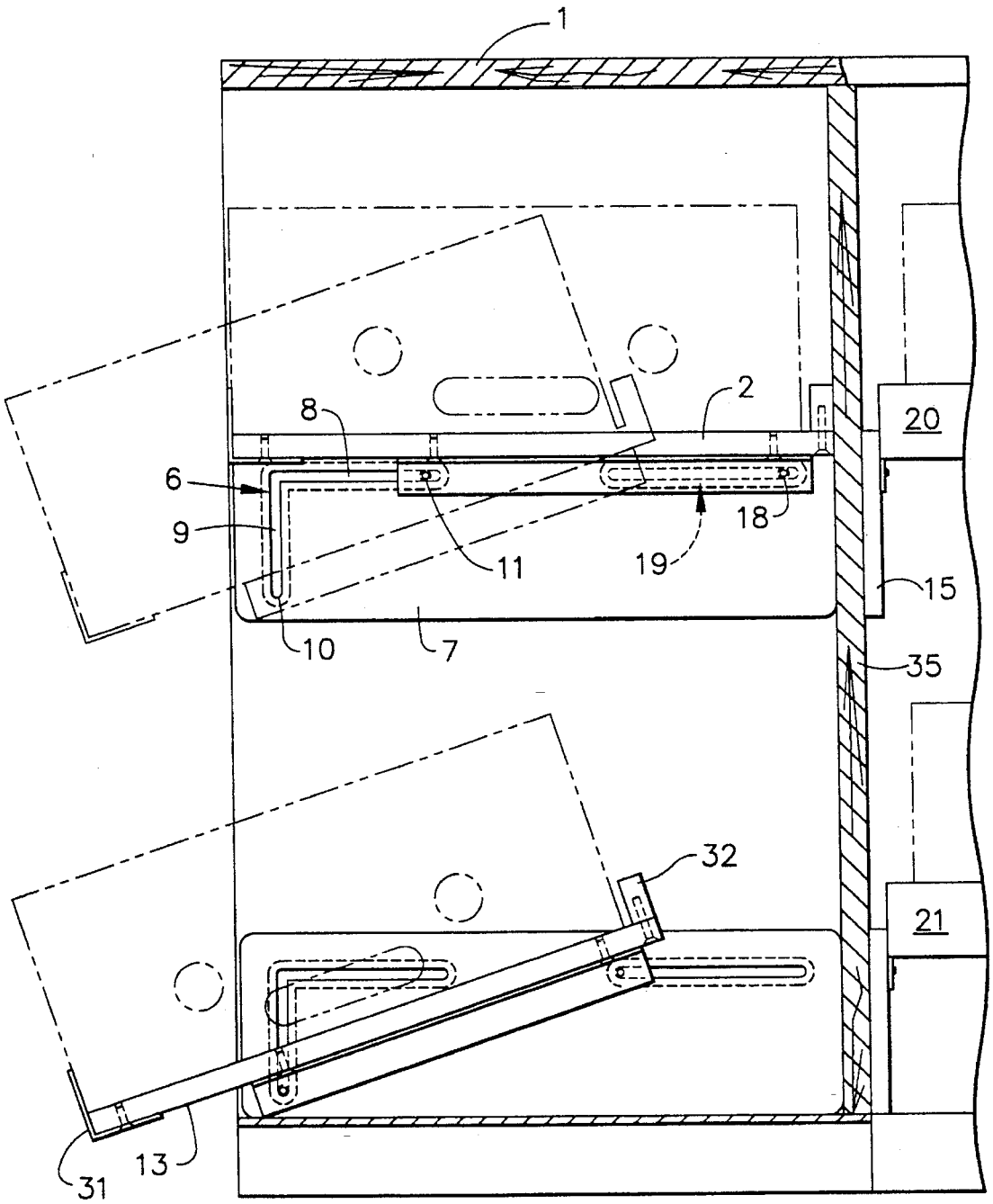
FIG. 3 is a partially cut-away view of the embodiments of FIGS. 1 and 2, and depicts the structure and operation of the drawer assemblies.
Figure 4:
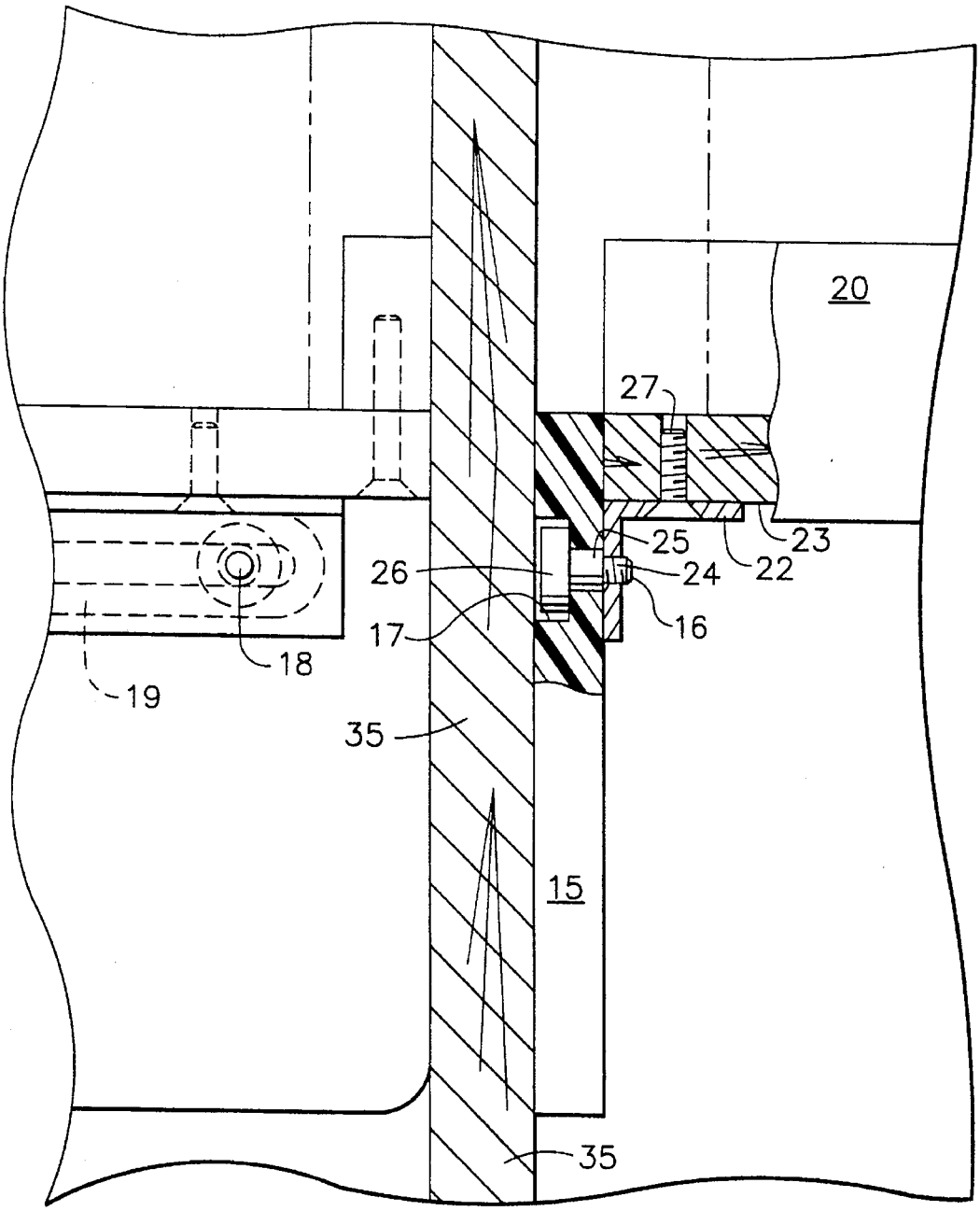
FIG. 4 is an enlarged view of a section of FIG. 3, with a portion of a second drawer assembly cut-away.

As mentioned previously, the drawers provided on the product display stands of the present invention are movable between closed and open positions. In order to accomplish this, the right and left sides of each drawer are slideably attached to the adjacent vertical support members. Thus, the right side of drawer 2 is slideably attached to support member 4, and the left side of drawer 2 is slideably attached to support member 5. This slidable attachment is best shown in FIGS. 3 and 4, wherein a first slide channel 6 is provided on the interior of vertical support member 4. Slide channel 6 may either be cut directly into the interior wall of first vertical support member 4, or it may be provided by means of slide plate 7 attached to the interior surface of support member 4 (as shown in FIGS. 3 and 4). Slide plate 7 is merely a flat plate which is secured to the interior of support member 4, and may be made of any suitable material, such as plastic. The assembly of slide plate 7 will be more fully discussed herein. Slide channel 6 comprises a horizonal section 8 and a downwardly extending section 9. Downwardly extending section 9 also has a terminus point 10. While downwardly extending section 9 is shown as being vertical, it may also slope of curve downwardly and still achieve the desired result.

A right slide coupling 11 is rigidly secured to, and extends away from, the right side of drawer 2. The portion of right slide coupling 11 which extends away from the right side of the drawer may then be slideably positioned within first slide channel 6. A similar first slide channel is also provided on second vertical support member 5, and is therefore adjacent and parallel to the left side of drawer 2. Likewise, a left slide coupling is provided on the left side of drawer 2. Although these structures at or near the left side of drawer 2 are not shown in FIGS. 3 and 4, the identical structures are shown for the left side of the second set of drawers which are positioned along the second vertical face 14 of the display stand. Thus, a left slide plate 15, as well as left slide coupling 16 and left first slide channel 17 are shown in FIGS. 3 and 4.

As will be understood from FIG. 3, as drawer 2 is pulled away from the interior of the display stand, the right and left slide couplings will slideably move within their respective first slide channels. As the right and left slide couplings move from the horizonal section to the downwardly extending section of their respective slide channels, the front portion of drawer 2 will begin to angle downwardly (preferably at an angle to the horizontal of about 45 degrees or less). Provided that a means for supporting the rear portion of drawer 2 is provided, when the right and left slide couplings reach the terminus point of the downwardly extending section of their respective slide channels, drawer 2 will be angled downwardly as shown in FIG. 3. A portion of the drawer also preferably extends out of the stand when the drawer is in the open position.

Several means of supporting the portion of drawer 2 positioned rearwardly of right slide coupling 11 and left slide coupling 16 may be provided. It should be noted that "rearward" refers to the direction from front face 31 towards rear face 32 of the drawer (see FIG. 3). The preferred method of accomplishing this is to provide a second right slide coupling 18 positioned rearwardly of first right slide coupling 11. An identical second slide coupling may also be provided on the left side of drawer 2. A second slide channel 19 is then provided on the interior of first vertical support member 4, and is preferably aligned with horizonal section 8 of first slide channel 6. In fact, second slide channel 19 may be combined with horizontal section 8 of first slide channel 6, to thereby essentially form a single, continuous slide channel.

As will be noted from FIG. 3, as drawer 2 is pulled outwardly, second right slide coupling 18 will slideably move within second slide channel 19. As first right slide coupling 11 moves through downwardly extending section 9 of the first slide channel, second right slide coupling 18 will pivot within slide channel 19, thereby maintaining the elevation of the rear portion of drawer 2 as the front portion of drawer 2 angles downwardly. The same result may also be accomplished by merely providing a ledge or lip corresponding in dimension to second slide channel 19. This ledge or lip can merely extend inwardly from the interior surface of vertical support members 4 and 5 to provide a support surface for the rear portion of drawer 2. In this fashion, as drawer 2 is pulled outwardly and the first slide couplings are moved into their respective downwardly extending sections of the first slide channels, the edge of the ledge or lip will act as a lever upon which the rear portion of the drawer will pivot.

As best shown by FIG. 4, the slide couplings are preferably attached to the drawers by means of a section of angle iron 22. Optionally, of course, the slide couplings may merely be fastened directly to the drawer itself, however strength may be sacrificed. As shown in FIG. 4, angle iron section 22 is secured to base 23 of drawer 20 such that the flat portion of angle iron 22 which extends downwardly from base 23 lies flush with the left edge of drawer 20. Angle iron 22 can be secured to base 23 in any suitable fashion, such as by screw 27. Left slide coupling 16 is then secured to angle iron 22 so that slide coupling 16 extends away from the left side of drawer 20. Left side coupling 16 can be secured to angle iron 22 by any suitable means such as treading, and the coupling itself can be of many different constructions. For example, slide coupling 16 could comprise a roller wheel such as those typically found in conventional desk drawers. As shown in FIG. 4, however, slide coupling 16 is preferably a shoulder bolt (also known as a socket-head shoulder screw) which has been threadably secured to angle iron 22. This shoulder bolt comprises a threaded section 24, a middle section 25, and a head 26. Left side channel 17, as well as the other slide channels of the invention, are preferably of a T shaped cross section, such that head 26 of slide coupling 16 will be held within slide channel 17 as shown in FIG. 4. As long as head section 26 and middle section 25 fit only loosely within the slide channel, the shoulder bolt (i.e., left slide coupling 16) will be able to freely slide within slide channel 17, thus providing the slidable attachment for drawer 20. Of course slide coupling 16 could also merely be a horizontal pin extending away from the left side of drawer 20, however the preferred construction shown in FIG. 4 provides a more secure slidable attachment to left side plate 15 which is secured to the corresponding vertical support member 35.

As will be more fully described below, the display stand of the present invention may have numerous slideably moveable drawers. Each of these drawers may be attached to the stand in the manner described immediately above. Thus, each drawer will be slideably attached to vertical support members positioned parallel and adjacent to the right and left sides of the drawer. This slidable attachment can be achieved by use of slide channels provided in slide plates attached to the vertical support members immediately adjacent to the right and left sides of each drawer.

Figure 11:
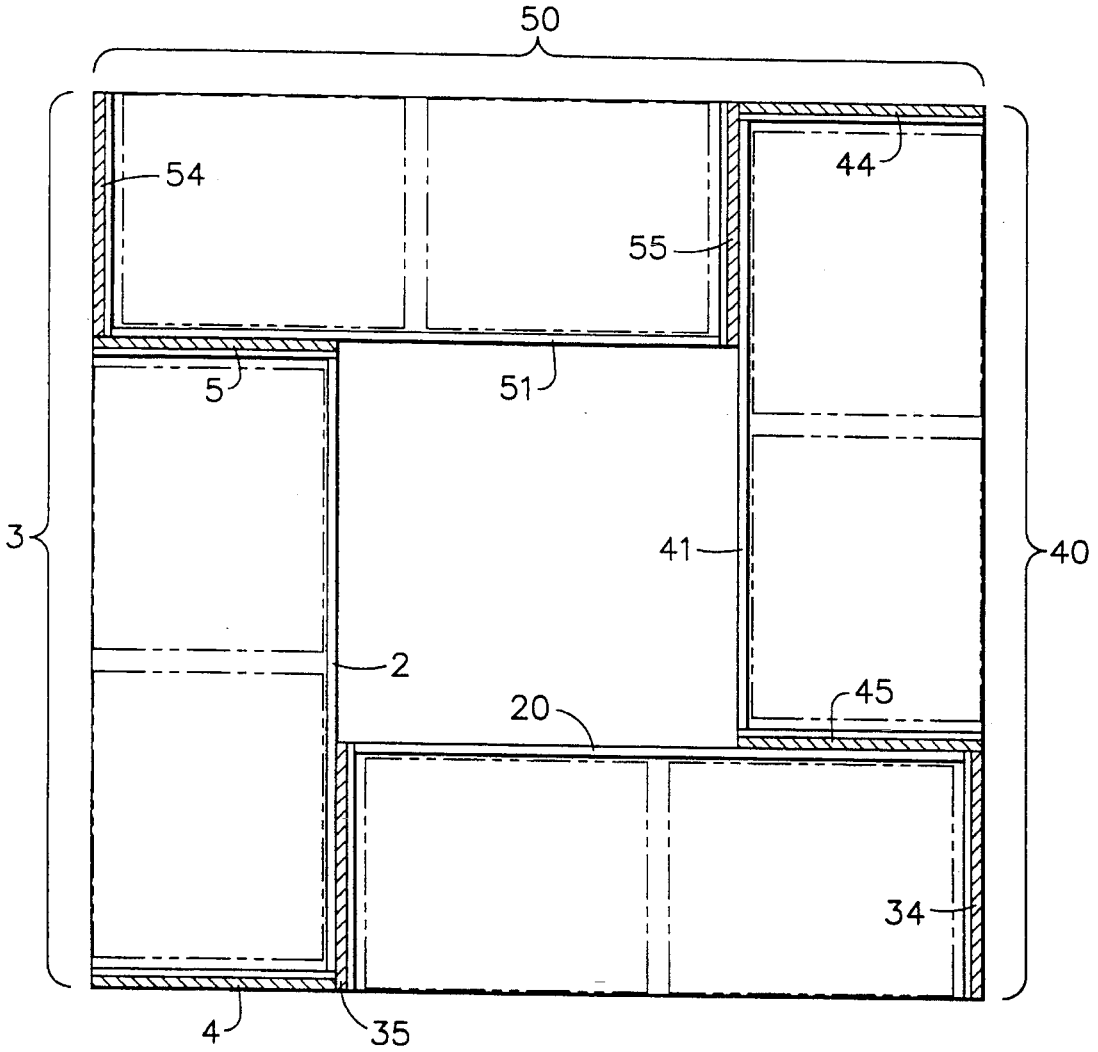
FIG. 11 is a top plan view of the embodiment shown in FIG. 1, wherein the display surface has been removed to show the interior of the display stand.

As shown in FIG. 11, the drawer configuration of the present invention provides for the presence of up to four sets (i.e., each set having one or more drawers vertically aligned with one another) in the stand. FIG. 11 is a top plan view of the display stand of FIG. 1, with display surface 1 removed. Thus, drawer 2 is shown having adjacent first and second vertical support members 4 and 5, respectively. Similarly, drawer 20 has corresponding third and fourth vertical support members 34 and 35, respectively, positioned adjacent and parallel to the right and left sides of drawer 20. Similarly, a third set of drawers may be provided along third vertical face 40. As shown in FIG. 11, fifth and sixth vertical support members 44 and 45 are positioned adjacent and parallel to the right and left ends of drawer 41 positioned along third vertical face 40. Finally, a fourth set of drawers may be provided along fourth vertical face 50. Thus, as further shown in FIG. 11, seventh and eighth vertical support members 54 and 55 are positioned adjacent and parallel to the right and left sides of drawer 51, respectively. The arrangement of the display stand as shown in FIGS. 1 and 11 thus provides an efficient use of nearly the entire volume of the stand positioned below display surface 1, and also provides drawer space around the entire periphery of the stand. Thus, the grocer or consumer may access products stored within the drawers from a position adjacent any of the four vertical faces of the stand. In addition, the portion of four of the vertical support members (4, 34, 44 and 54) which is positioned external of the stand, provides a convenient and readily-visible location for various indicia. For example, product logos can be affixed to the external surface of these four vertical support members, such as shown by the letter A on support member 4 of FIG. 1.

Figure 8:
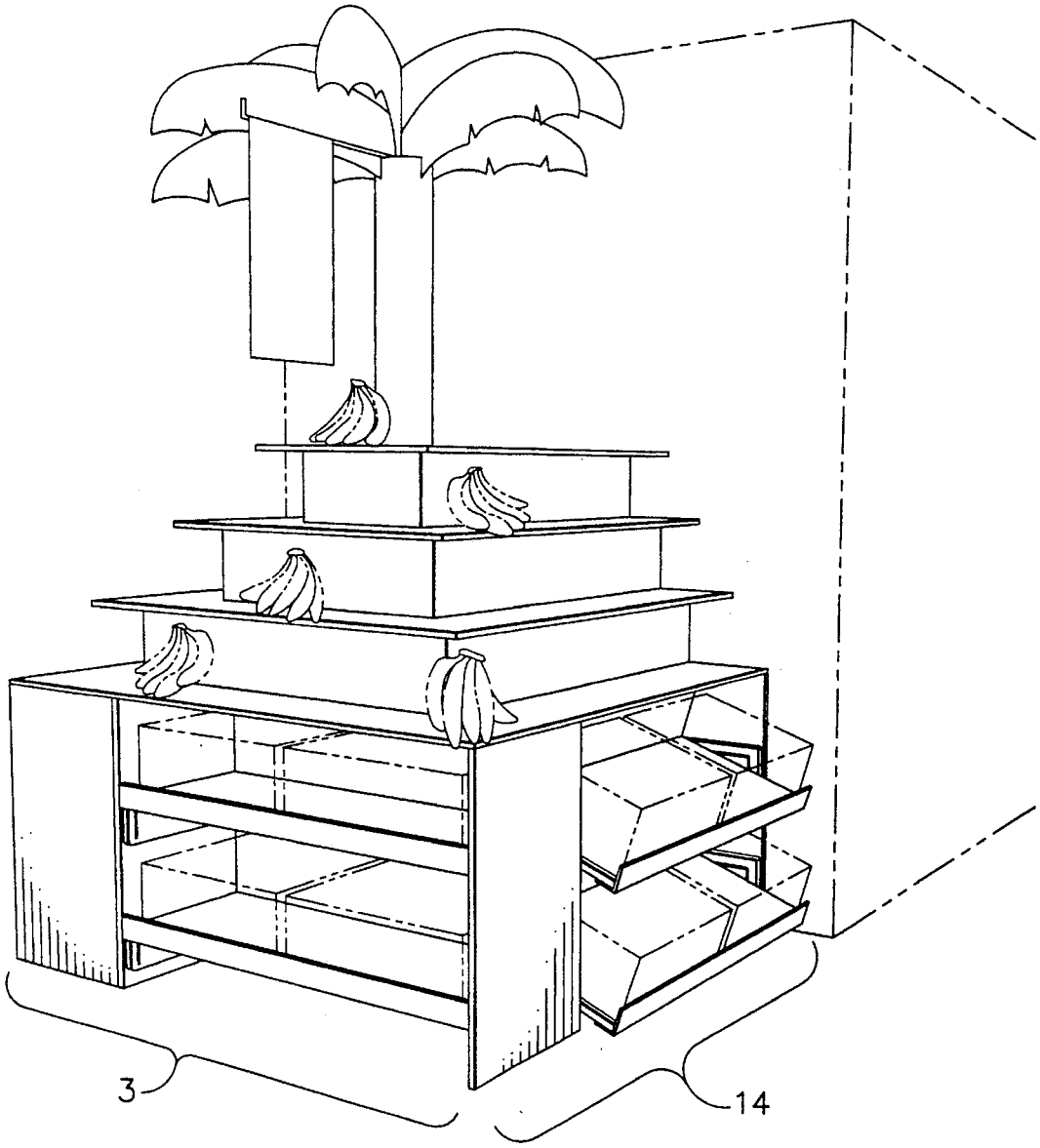
FIG. 8 is a perspective view of yet another embodiment of the invention.

One advantage of the configuration shown in FIGS. 1 and 11 is that it can be readily modified to provide units suitable for placement in various locations within the retail establishment. In FIG. 8, for example, a display stand suitable for placement against a wall or other vertical surface if provided. Such a display stand is often referred to as an "end cap" display, and is often positioned at the end of a row of display units. In the display stand of FIG. 8, the fourth set of drawers positioned along fourth vertical face 50 of FIG. 11 have been removed. Thus, vertical support member 44 of FIG. 11 can be merely extended across the entire vertical face 50 to a point where it meets vertical support member 54. In this manner, in the embodiment of FIG. 8, fourth vertical face 50 is merely a solid vertical wall.

Figure 10:
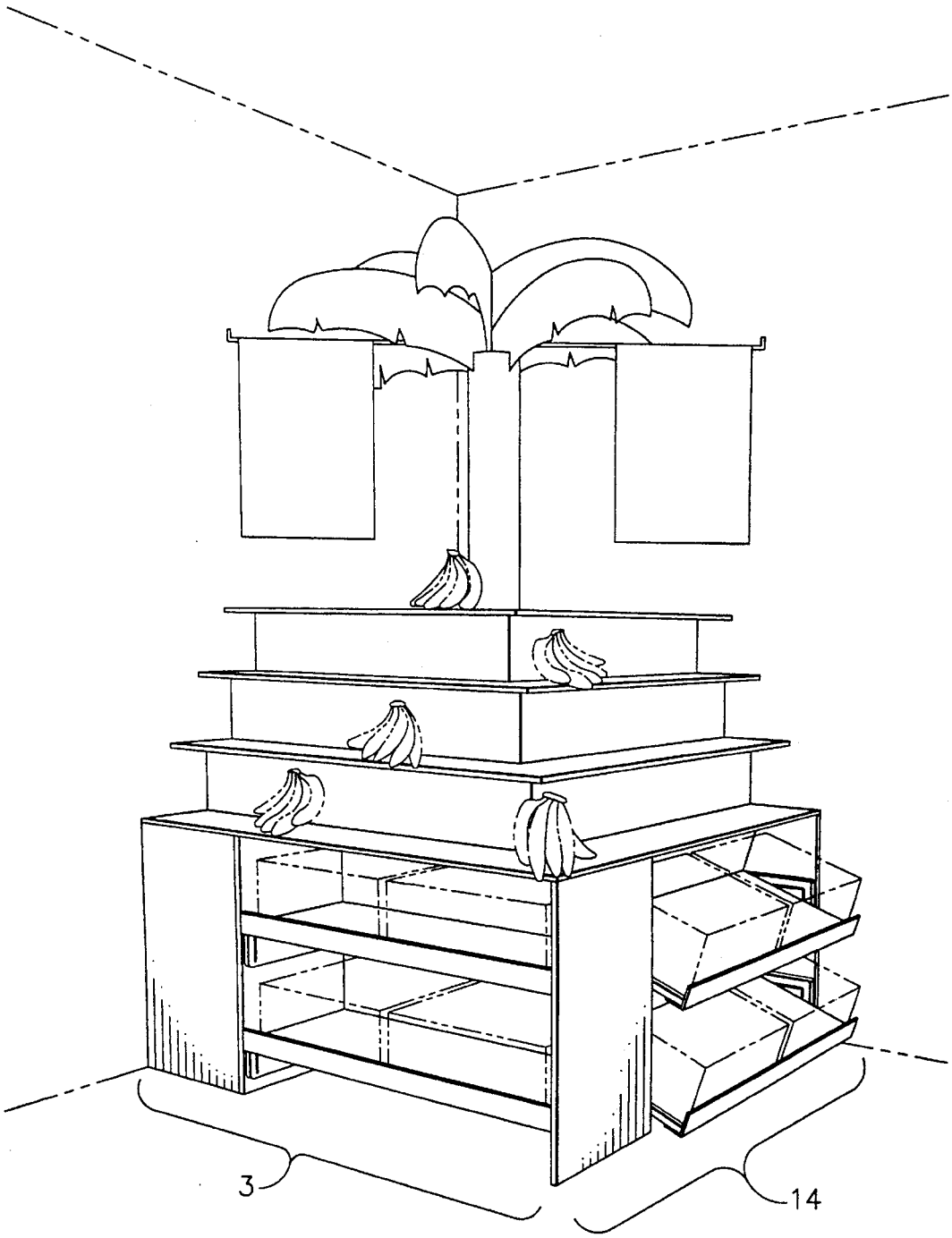
FIG. 10 is a perspective view of yet another embodiment of the invention.

In a similar fashion, FIG. 10 depicts a display stand suitable for placement in a corner of the retail space. In the device of FIG. 10, the sets of drawers positioned along both the third and fourth vertical faces (40 and 50 of FIG. 11) have been removed. In the stand of FIG. 10, the third and fourth vertical faces may merely be solid vertical walls. Of course the display stand of FIGS. 1 and 11 having drawers about all 4 vertical faces could be placed in a corner as shown in FIG. 10, however the third and fourth sets of drawers would not be accessible.

Figure 5:
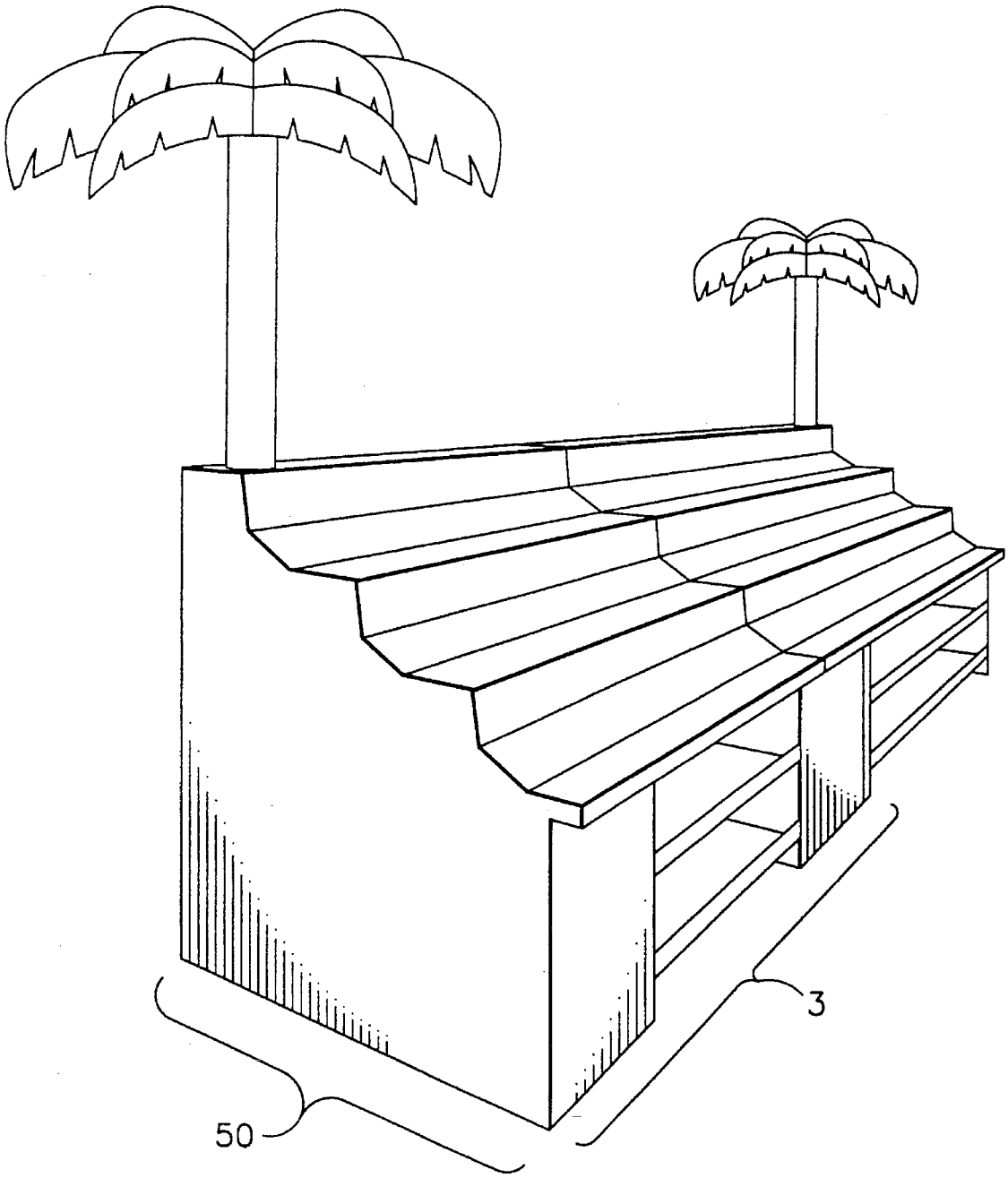
FIG. 5 is a perspective view of yet another embodiment of the invention.
Figure 6:
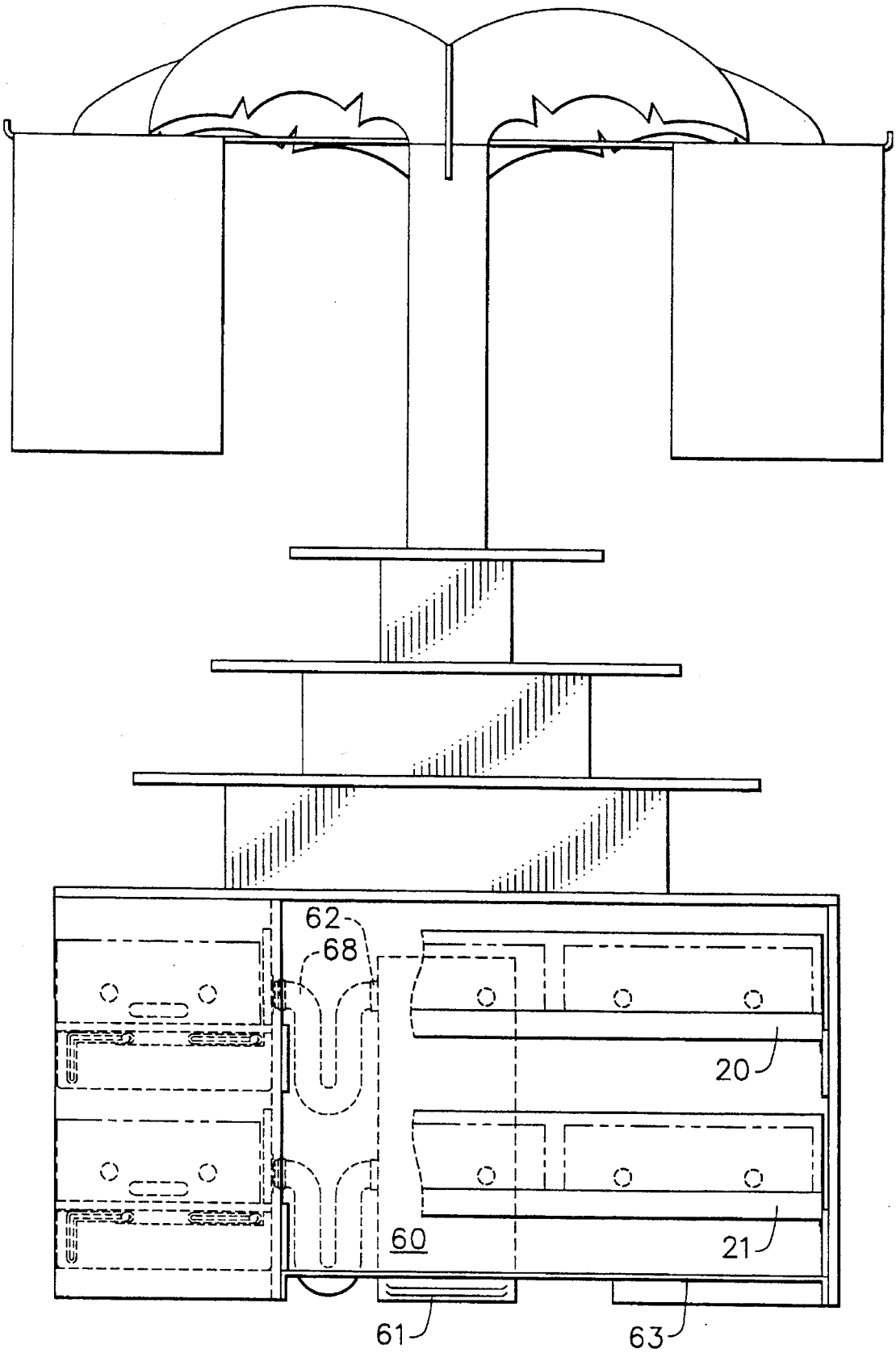
FIG. 6 is a cut-away view of another embodiment of the present invention.

Yet another embodiment of the display stand is shown in FIG. 5. The stand of FIG. 5 would typically be positioned along a vertical wall, and provides drawers only along first vertical surface 3. The second, third and fourth vertical faces of the display stand of FIG. 5 are merely vertical walls which extend to the lower edge of the display surface. The drawer assemblies in the device of FIG. 5, however, are identical to that previously described. In addition, a plurality of the display stands shown in FIG. 5 may be positioned end to end in order to provide additional display and storage space. Thus, in FIG. 5 two such display stands placed end to end are shown.

Returning now to the drawer structure of the display stands of the present invention, as best shown by FIG. 1, drawer 2 comprises a planar base portion 30, front face 31, and rear face 32. Base portion 30 is preferably merely a flat, rectangular structure, and front and rear faces 31 and 32 may be rectangular structures having a length approximately equal to that of base portion 30. Alternately, front and rear faces 31 and 32 may comprise angle brackets secured to base portion 30 (as best shown by FIG. 3 for front face 31 ). The front and rear faces of each drawer may be attached in any suitable manner, such as by a screw or by gluing. Front face 31 is preferably sized so as to fully retain boxes placed within the drawers even while the drawers are angled downwardly, while also not entirely covering the front sides of the boxes placed therein. Such sizing of front face 31 is particularly desirable when boxes having ventilation openings (such as shown by phantom lines in FIG. 2), and/or when the grocer would like the consumer to observe indicia placed upon the sides of the boxes stored within the drawer (such as product logos). If front face 31 is low enough so as to not cover the ventilation openings, improved ventilation can be provided to the interior of the boxes. In addition, since many boxes such as those used for produce contain various indicia and trademarks on the sides of the boxes, it is also desirable to allow the consumer to visually perceive the material printed on the sides of the boxes. Having a low front face 31 insures that this will be the case. Thus, front face 31 is preferably only as high as necessary to retain the boxes within the drawers when the drawers are in the open position (i.e., angled downwardly).

Figure 7:
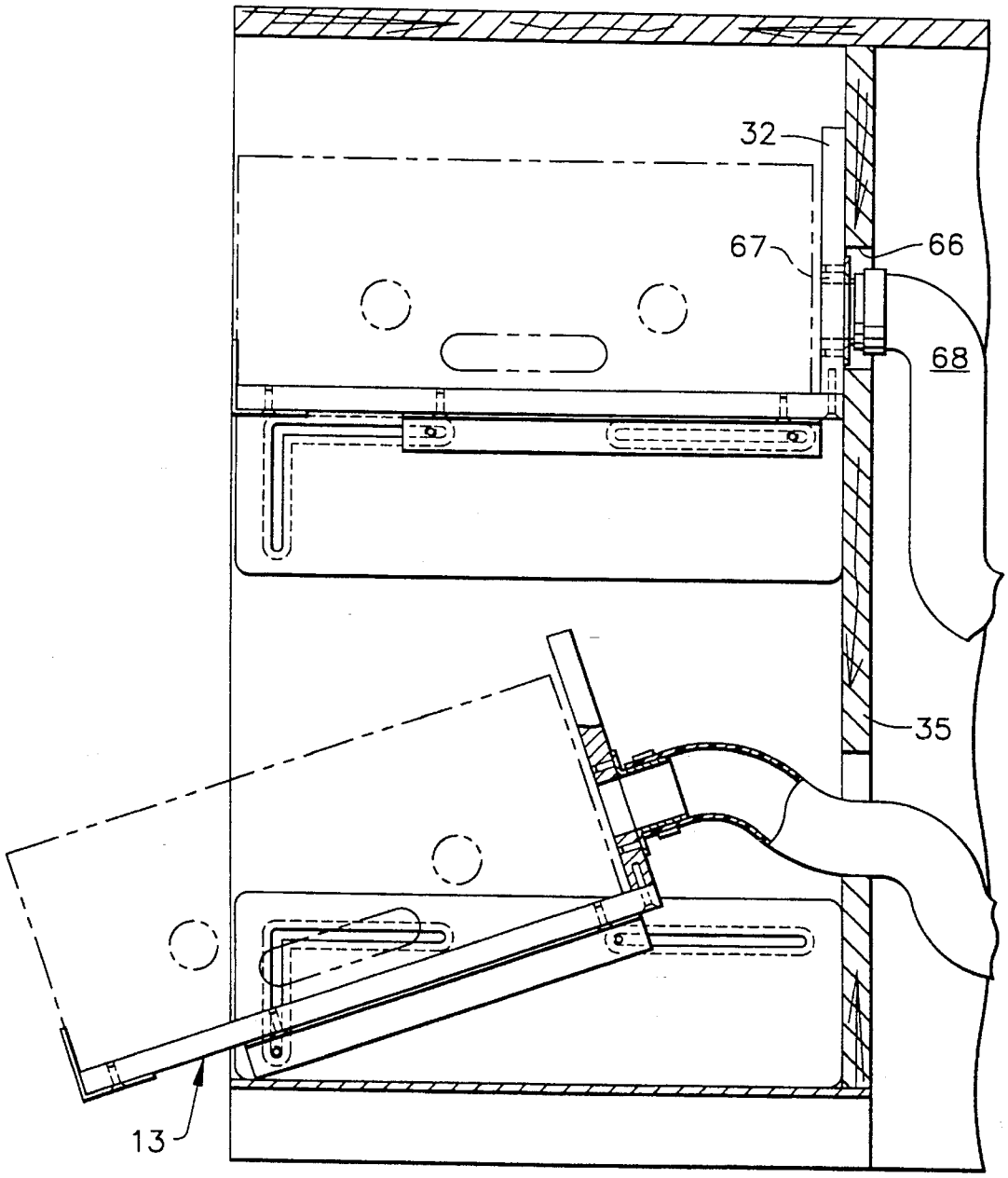
FIG. 7 is a partially cut-away view of an enhancement of the embodiments of FIGS. 1 and 2, and depicts the structure and operation of the drawer assemblies as well as the use of air hoses for cooling purposes.

Rear face 32 may also be sized identically to front face 31, as shown in FIG. 1. For added strength and improved retention of boxes contained within the drawers, however, rear face 32 may also be extended as high as desired, as long as rear face 32 does not interfere with movement of the drawers. Thus, as shown in FIG. 7, rear face 32 may extend above the height of the boxes placed within the display stand. Since there is no concern of rear face 32 blocking the observation of the sides of the box, the only concern is that adequate ventilation be provided to products stored within the drawers when necessary. As will be discussed further herein, however, supplemental ventilation means may be provided in order to insure adequate ventilation to the product contained within the drawers even when the larger rear faces are employed on the drawers.

Figure 12:
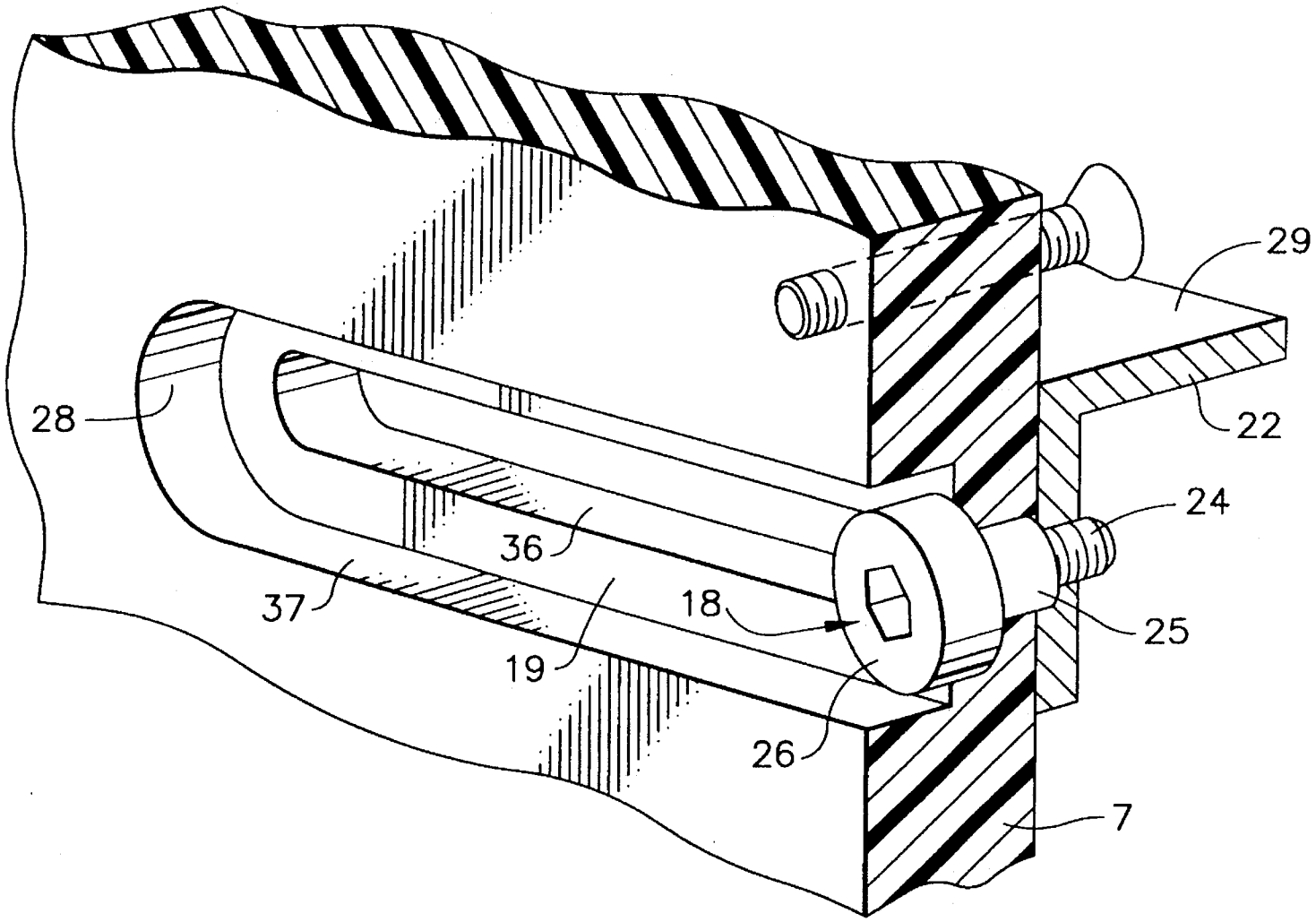
FIG. 12 is a close-up cross-sectional view of the slide mechanism of the present invention.

As mentioned previously, the slide channels present on the vertical support members of the present invention may be provided by means of a slide plate. This structure is shown in the cut-away, isometric view of FIG. 12, wherein right slide plate 7 having second slide channel 19 is shown. Slide channel 19 is of a T-shaped cross-section, and has a terminus point 28. Slide coupling 18 can be of numerous constructions, however, it is shown in FIG. 12 as a shoulder bolt, often referred to as a socket-head shoulder screw. In order to construct the drawer assembly of the present invention, slide coupling 18 is inserted into slide channel 19 such that middle section 25 of coupling 18 is positioned within first section 36 of slide channel 19, and head 26 of coupling 18 is positioned within second section 37 of slide channel 19. The T-shaped configuration of the slide channel insures that the bolt will be retained within slide channel 19, and that coupling 18 can freely slide within channel 19. Threaded portion 24 of slide coupling 18 may then be threaded into angle iron section 22 thereby securing coupling 18 to angle iron 22. Optionally, a washer may be placed between middle section 25 of coupling 18 and angle iron section 22, to improve the slideability. Slide plate 7 may then be secured to the interior of first vertical support member 4. This may be accomplished, for example, by means of a plurality of screws. Drawer 2 may then be placed upon horizontal surface 29 of angle iron 22, and secured thereto by any number of means.

Figure 2:
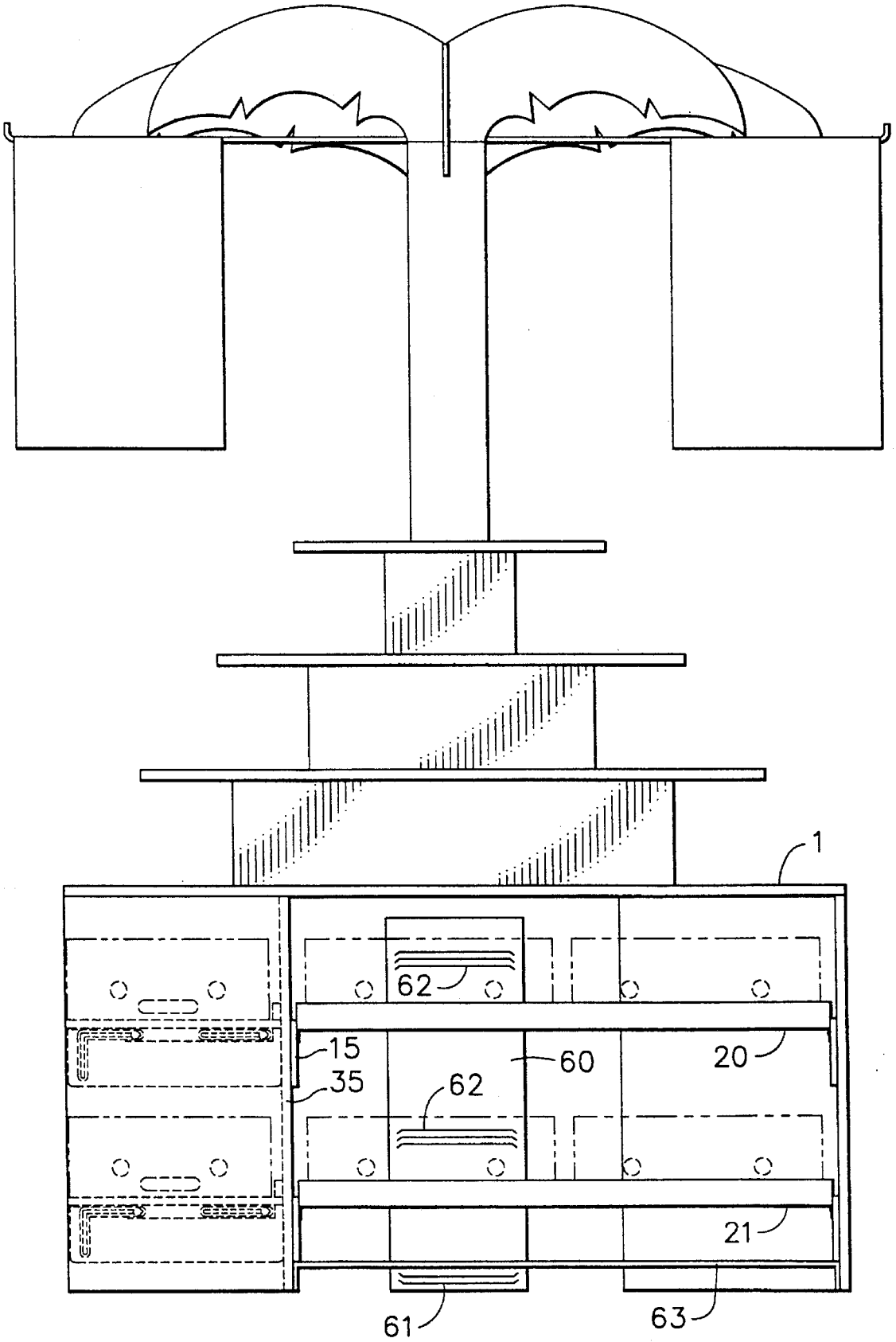
FIG. 2 is a cut-away view of another embodiment of the present invention.

As mentioned previously, many products to be displayed in the stands of the present invention also benefit from cooling and/or humidification. Thus, as shown in FIG. 2, an optional cooling unit 60 may be provided within the interior of the display stand. The cooling unit may also, when needed, provide humidification. This is particularly true when the product being displayed and stored is bananas, as this product greatly benefits from being stored in a cool (56°–59° F.) moist atmosphere. Cooling unit 60 may operate by any of a number of means, and preferably is of a type which provides an economical, easily-operated source of cool and/or moist air. This can be achieved, for example, by providing a simple evaporative cooling unit (commonly referred to as a "swamp cooler"). Of course, a more expensive refrigerated cooling unit 60 can also be provided. As shown in FIG. 2, air is drawn into cooling unit 60 through intake 61, and the cooled and/or humidified air is dispelled through vents 62. Vents 62 are preferably aligned with the ventilation openings in the boxes stored in the unit in order to insure efficient cooling of the boxes. Of course, other arrangements for the vents are possible, and it is also preferred that the vents be positioned so that the air can be directed towards as many drawers of the display stand as possible. Thus, in the example shown, vents would be provided about the entire periphery of the cooling unit.

The efficiency of the cooling of product stored within the display stand can be greatly improved by regulating the air flow into and out of cooling unit 60. Thus, as shown in FIG. 1, baffle plate 63 is provided along first vertical face 3 parallel to the surface upon which the display stand rests. As will be more fully understood below, a baffle can also be provided on one or more of the other vertical faces of the display stand. The purpose of baffle plate 63 is to regulate the source and flow of the air which is drawn into cooling unit 60 through intake 61. As shown in FIG. 2 wherein baffle plate 63 is now provided on second vertical face 14, baffle plate 63 will help insure that air is drawn into the cooling unit through the air channel formed between baffle plate 63 and the surface upon which the display stand rests. This insures that air is drawn into cooling unit 60 from a location beneath bottom-most drawer 21. In addition, as will be more fully understood below, it may in some instances be desirable to completely segregate air intake 61 from the interior of the display stand. To accomplish this, a baffle plate may be provided along each vertical face of the display stand extending inwardly towards intake 61, and extending across the entire interior of the stand to completely seal off the intake from the interior of the stand. This will insure that air can only be drawn into intake 61 through the air channels formed between the baffle plates and the surface upon which the display stand rests. Baffle plate 63 thus provides fluid communication between air intake 61 and the ambient through the air channel located between baffle plate 63 and the surface upon which the display stand rests. As will be obvious, this air channel will also be defined by the vertical support members positioned at either end of baffle plate 63. As an alternative, baffle plate 63 could be located directly beneath display surface 1 to thereby provide an air channel between display surface I and the baffle plate, along with a corresponding adjustment in the location of intake 61. Of course, fluid communication between air intake 61 and ambient air external of said display stand can be accomplished by any of a number alternative means. For example, in the device shown in FIG. 2, air could even be drawn through the tree structure located atop the uppermost display surface. The only modification would be that air intake 61 would need to be located atop cooling unit 60 in fluid communication with the ambient external air.

Figure 9:
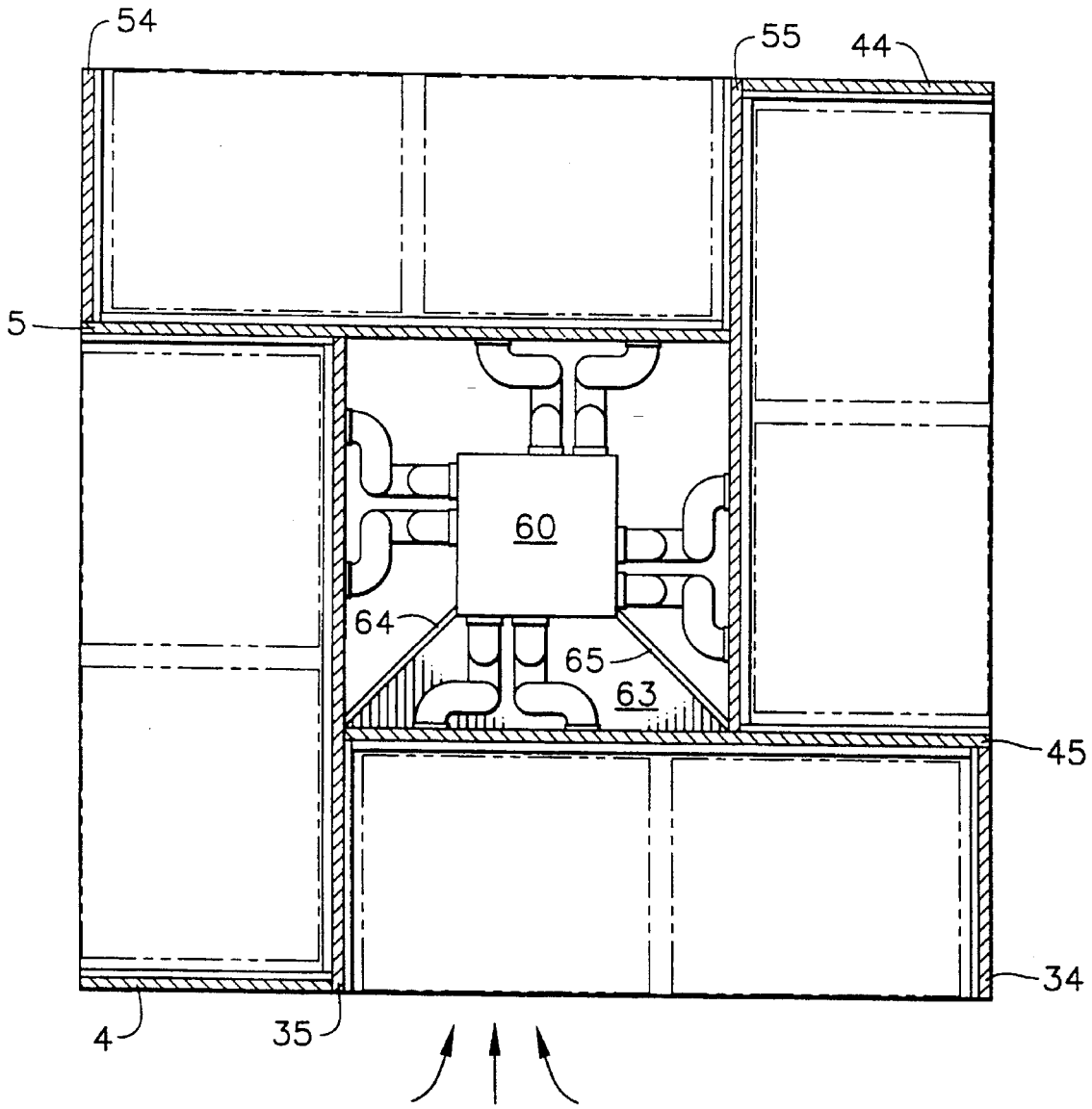
FIG. 9 is a top plan view of the embodiment shown in FIG. 7, wherein the display surface has been removed to show the interior of the display stand.

FIG. 9 shows yet another means for segregating air intake into cooling unit 60. In this configuration, baffle plate 63 is provided along second vertical face 14 as shown in FIG. 2. In addition, air flow segregation is improved by also providing duct plates 64 and 65. Baffle plate 63 is then extended inwardly until it meets cooling unit 60. Duct plate 64 and 65 need be no higher in height than the distance between baffle plate 63 and the surface upon which the display stand rests. In this fashion, air will be drawn into the cooling unit through the air channel formed by baffle plate 63, duct plates 64 and 65, and the surface upon which the display stand rests. As will be understood, since second vertical support member 45 extends completely to the surface upon which the display stand rests (except in the area traversed by baffle plate 63), complete airflow segregation can be achieved: air is only drawn into cooling unit 60 from beneath drawer 21.

As shown in FIG. 11, the embodiment of the display stand of the present invention which has heretofore been described may be supported entirely by the 4 L-shaped structures formed from the vertical support members and located at the 4 corners of the display stand. In order to provide further support to the structure, and also to improve air flow into the drawers when cooling unit 60 is employed, each of the four internally extending vertical support members (5, 35, 45 and 55), may be extended through the interior of the display stand until each abuts against the opposite internally extending vertical support member. Thus, as shown in FIG. 9, vertical support member 5 can be extended through the interior of the display stand until it abuts against second vertical support member 55. The structure thus shown in FIG. 9 will be sturdier than that shown in FIG. 11, and thus may, in some instances, be more desired.

In addition, the extension of the four second vertical support members that are shown in FIG. 9 will act to create a plenum chamber within the interior of the display stand when baffle plate 63 and duct plates 64 and 65, or equivalent structures, are employed. In the stand of FIG. 9, the plenum chamber will be bounded by the underside of display surface 1, the four internally extending vertical support members (5, 35, 45 and 55), and the surface upon which the stand rests, provided that air drawn into the cooling unit is drawn through an air channel segregated from the interior of the display stand (as previously described). As shown in FIG. 7, an air duct 66 can then be provided in vertical support member 35. If rear face 32 is sufficiently short so that it does not block air duct 66, cooled air exiting the vents on cooling unit 60 will be directed and dispelled from the plenum chamber through air duct 66 into drawer 2. When items such as banana boxes are stored in drawer 2, air duct 66 can be positioned so that it aligns with the standard ventilation openings on the banana boxes, to thereby further direct the air flow from cooling unit 60 directly into the interior of the banana boxes. Alternatively, when rear face 32 of drawer 2 extends above the height of the box, air duct 67 may be provided in rear face 32. Obviously when drawer 2 is in the closed position, as shown in FIG. 7 air duct 67 must be aligned with air duct 66 to insure proper air flow into the interior of drawer 2 from the plenum chamber. As will be understood, similar air ducts may be provided in all of the second vertical support members in order to direct the air flow from the plenum chamber into each drawer, at the desired location.

To even further enhance air flow into the drawers, and in most instances into the boxes stored within these drawers, air hoses may be employed. Thus, as shown in FIGS. 7 and 9, cooled and/or humidified air is expelled from cooling unit 60 through one or more air hoses. In FIG. 7, air hose 68 extends from cooling unit 60 through air duct 66 and is aligned with air duct 67 of rear face 32. Air hose 68 is then preferably secured to rear face 32 by any suitable means. Air hose 68 is preferably of a flexible material such as rubber, and may even be of a pleated, accordion-like construction. Air hose 68 is preferably of sufficient length so that when drawer 2 is moved to the open position, air hose 68 will remain attached to rear face 32 and will be extended through air duct 66. In this fashion, fluid communication between cooling unit 60 and the drawer can be maintained even when the drawer is in the open position. Thus, as shown lower drawer 13 in FIG. 7, when a drawer attached by means of an air hose to cooling unit 60 is open, the air hose is merely extended through the air duct in the second vertical support member, and maintains its connection with the rear face of the drawer. When banana boxes, or the like are placed in the drawer, with these boxes having ventilation openings which align with air ducts contained in the rear face of the drawer, cooled and/or humidified air can be continually expelled into the interior of the banana boxes whether the drawer is in the open or closed position (as shown in FIG. 7). Alternatively, the air hose could merely be attached to the vertical support member, however in this instance air would not be forced into the boxes when the drawers are in the open position.

As mentioned previously, the present invention also comprises a method for displaying and storing produce, such as bananas. The display stand of the present invention is employed in this method, and the produce to be displayed is placed atop the display surface of the stand. After the display surface has been stocked, the remaining boxes of produce are then placed within the drawers of the display stand. The drawers may then be either moved to their closed position, or may even be maintained in their open, downwardly angled position. In both cases, indicia on the sides of the boxes are clearly visible to the consumer. In addition, when the drawers are in their open position, the interior of the boxes can be viewed, and thus it is desirable that the tops of the boxes stored within the drawers are first removed before placing them within the drawers. When produce is removed from the display surface by the consumer, the grocer may then remove additional product from the boxes contained within the drawers, placing the same atop the display surface. In this fashion, the grocer will have to make fewer trips to the storage areas where additional boxes of the produce are kept. In addition, the provision of a cooling and/or humidification unit in the stand will further prolong the shelf life of the produce being displayed and stored. The overall effect is that an aesthetically-pleasing display of the produce is presented to the consumer, and the quality of the produce itself is improved.

The foregoing description is by no means exhaustive of the variations in the present invention that are possible, and has been presented only for purposes of illustration and description. Obvious modifications and variations will be apparent to those skilled in the art in light of the teachings og the foregoing description. For example, various alternative means segregating air flow into and out of the cooling unit container could be employed. Additionally, various alternative materials could be used to manufacture the various components of the system and method. Thus, it is intended that the scope of the present invention be defined by the claims appended hereto.

What we claim is:

1. A product display stand comprising:

(a) at least one display surface for displaying a product thereupon;

(b) a first vertical face positioned beneath said display surface; and (c) at least one drawer positioned beneath said display surface for storing said product, said drawer movable between a closed position and an open position and comprising a front face of a height that promotes air circulation across said drawer, wherein said drawer is disposed within said stand when the drawer is at said closed position, wherein said drawer is angled downwardly when the drawer is at said open position, and wherein said drawer may be moved from the closed position to the open position by slideably moving the drawer from the interior of the stand in the direction of said vertical face; and (d) a cooling unit capable of dispelling cooled air, said cooling unit positioned beneath said display surface and within said stand, such that said cooled air can be dispelled into said drawer, thereby cooling product stored within said drawer.

2. The display stand of claim 1, wherein said cooling unit has an air intake, and further comprising an air channel aligning said intake with the ambient so that air entering said cooling unit can be drawn from the ambient through said air channel into said intake.

3. The display stand of claim 2, further comprising an airflow baffle positioned beneath said display surface in order to provide said air channel.

4. The display stand of claim 3, wherein said baffle is positioned beneath said drawer parallel to the surface upon which said stand rests.

5. The display stand of claim 2, wherein the interior of said display stand comprises a plenum chamber having an air pressure greater than the ambient air pressure, wherein said cooling unit has at least one vent through which cooled air is expelled into said plenum chamber, and wherein said stand has at least one air duct which provides fluid communication between said plenum chamber and said drawer such that cooled air in said plenum chamber can be expelled through said duct into said drawer.

6. The display stand of claim 2, further comprising at least one air hose secured to said cooling unit such that cooled air dispelled from said cooling unit can be forced through said air hose, wherein said drawer has a rear face having at least one air duct, and wherein said hose is attached to said rear face in fluid communication with said air duct, such that cooled air dispelled from said cooling unit will pass through said hose and said air duct into said drawer.

7. The display stand of claim 2, wherein said drawer has a rear face, and further comprising a vertical support member positioned within said stand, said rear face of said drawer positioned parallel and adjacent to said vertical support member, further comprising at least one air hose secured to said cooling unit such that cooled air dispelled from said cooling unit can be forced through said air hose, wherein at least one air duct is provided on said vertical support member, said air duct aligned with said drawer, and wherein said hose is attached to said vertical support member in fluid communication with said air duct, such that cooled air dispelled from said cooling unit will pass through said hose and said air duct into said drawer.

8. A method for displaying and storing bananas, comprising the steps of:

(a) providing a plurality of boxes containing bananas;

(b) providing a product display stand comprising:

at least one display surface for displaying a product thereupon;

a first vertical face positioned beneath said display surface; and at least one drawer positioned beneath said display surface for storing said product, said drawer movable between a closed position and an open position and comprising a front face of a height that promotes air circulation across said drawer, wherein said drawer is disposed within said stand when the drawer is at said closed position, wherein said drawer is angled downwardly when the drawer is at said open position, and wherein said drawer may be moved from the closed position to the open position by slideably moving the drawer from the interior of the stand in the direction of said vertical face;

(c) removing a portion of the bananas contained in said boxes and placing said removed bananas upon said display surface;

(d) placing said boxes containing the remaining bananas in said drawer;

(e) displaying said stand to customers, so that said customers may remove said bananas from said display surface for purchase; and (f) removing at least a portion of said remaining bananas from said boxes in said drawer, and placing said portion of said remaining bananas on said display surface in order to replace said bananas removed by customers.

9. The method of claim 8, further comprising the step of moving said drawer to said closed position after said boxes containing said remaining bananas are placed in said drawer.

10. The method of claim 9, further comprising the steps of:

(a) providing a cooling unit capable of dispelling cooled air, said cooling unit positioned beneath said display surface and within said stand, such that said cooled air can be dispelled into said drawer, thereby cooling product stored within said drawer; and (b) dispelling cooled air from said cooling unit into said drawer in order to cool bananas stored in said drawer.

11. The method of claim 10, wherein said cooled air is dispelled at a temperature of between about 50° and about 60° F.

12. A product display stand comprising:

(a) at least one display surface for displaying said product thereupon;

(b) a first vertical face positioned beneath said display surface;

(c) at least one drawer positioned beneath said display surface for storing said product, said drawer movable between a closed position and an open position, and wherein:

(i) said drawer is disposed within said stand when the drawer is at said closed position;

(ii) said drawer is angled downwardly when the drawer is at said open position;

(iii) said drawer may be moved from the closed position to the open position by slideably moving the drawer from the interior of the stand in the direction of said vertical face;

(iv) the from of said drawer is positioned flush with said first vertical face when said drawer is at said closed position, and wherein at least a portion of said drawer is positioned externally of said stand when said drawer is at said open position;

(vi) said first drawer has a right side and a left side; and (d) first and second vertical support members positioned within said stand, said first vertical support member positioned adjacent and parallel to said right side of said drawer, and said second vertical support member positioned adjacent and parallel to said left side of said drawer, wherein:

(i) each side of said drawer is slideably attached to the adjacent vertical support member;

(ii) said first and second vertical support members each have a first slide channel, wherein each of said first slide channels has a horizontal section and a downwardly extending section, said downwardly extending section having a terminus;

(iii) said drawer further comprises:

(a) at least one right slide coupling rigidly secured to, and extending away from, the right side of said drawer, wherein a portion of said right slide coupling is slideably positioned within said first slide channel of said first vertical support member; and (b) at least one left slide coupling rigidly secured to, and extending away from, the left side of said drawer, wherein a portion of said left slide coupling is slideably positioned within said first slide channel of said second vertical support member;

(iv) said right and left slide couplings can slideably move from said horizontal section of their respective slide channels to said terminus of said downwardly extending section as said drawer is moved from said closed position to said open position, thereby causing said drawer to angle downwardly when at said open position;

(v) each of said vertical support members has a second horizontal slide channel;

(vi) said at least one drawer further comprises:

(a) a second right slide coupling secured to, and extending away from, the right side of said drawer, said second right slide coupling located rearwardly of said at least one right slide coupling, wherein a portion of said second right coupling is slideably positioned within said second slide channel of said first vertical support member; and (b) a second left slide coupling secured to, and extending away from, the left side of said drawer, said second left slide coupling located rearwardly of said at least one left slide coupling, wherein a portion of said second left coupling is slideably positioned within said second slide channel of said second vertical support member.

13. The product display stand of claim 12 further comprising a cooling unit capable of dispelling cooled air, said cooling unit positioned beneath said display surface and within said stand, such that said cooled air can be dispelled into said drawer, thereby cooling product stored within said drawer and wherein said cooling unit has an air intake, and further comprising an air channel aligning said intake with the ambient air so that air entering said cooling unit can be drawn from the ambient air through said air channel into said intake.

* * * * *

UNITED STATES PATENT AND TRADEMARK OFFICE

CERTIFICATE OF CORRECTION

PATENT NO. : 5,599,079

DATED : February 4, 1997

INVENTOR(S) : Douglas Ranno & David S. Stevens

It is certified that error appears in the above-indentified patent and that said Letters Patent is hereby corrected as shown below:

Column 16, line 54 (claim 12), "from" should read as --front--.

Signed and Sealed this

Fifth Day of August, 1997

Bruce Lehman

*Attest:*

BRUCE LEHMAN

*Attesting Officer*

*Commissioner of Patents and Trademarks*